United States Patent [19]

Trapasso et al.

[11] 4,172,173

[45] Oct. 23, 1979

[54] ETHYLENE-VINYL ACETATE POLYMER BINDERS FOR NON-WOVEN FABRICS

[75] Inventors: Louis E. Trapasso, Watchung; Charles L. Smart, Millington, both of N.J.

[73] Assignee: Celanese Corporation, New York, N.Y.

[21] Appl. No.: 701,320

[22] Filed: Jun. 30, 1976

[51] Int. Cl.[2] ..... B32B 27/04; C08J 5/18; D04H 5/04

[52] U.S. Cl. ..... 428/288; 260/29.6 ME; 428/290; 525/186

[58] Field of Search ..... 428/288, 290, 522, 523, 428/520; 260/897 R, 29.6 ME

[56] References Cited

U.S. PATENT DOCUMENTS

| | | | |
|---|---|---|---|
| 2,674,619 | 4/1954 | Lundsted | 260/30.8 R |
| 2,785,949 | 3/1957 | Kress | 427/394 |
| 3,062,768 | 11/1962 | von Brachel | 260/29.6 ME |
| 3,423,353 | 1/1969 | Levine | 260/29.6 ME |
| 3,622,531 | 11/1971 | Buselli | 260/29.6 ME |
| 3,692,723 | 9/1972 | Kasagi | 260/29.6 ME |
| 3,746,679 | 7/1973 | Seipel | 260/29.6 ME |
| 3,746,681 | 7/1973 | McClain | 260/29.6 ME |

*Primary Examiner*—Ellis Robinson

[57] ABSTRACT

Non-woven fabric binders of ethylene-vinyl ester copolymers containing effective amounts of an alkyl polyether.

2 Claims, No Drawings

ETHYLENE-VINYL ACETATE POLYMER BINDERS FOR NON-WOVEN FABRICS

BACKGROUND OF THE INVENTION

The early discovery that felt-like products could be made out of animal fibers, e.g., wool and fur, without weaving, has led man on a continuing search over the years for methods of binding other well-known fibers which do not naturally felt. Surprisingly little help was available from the age-old art of paper making, wherein cellulosic fibrous materials, such as wood pulp, are inherently readily bonded into a dimensionally strong sheet. For example, by simply beating cellulosic wood fibers, forming a dilute aqueous suspension thereof, and depositing same on a travelling wire-gauze screen or a rotating gauze-covered cylinder, paper sheets having excellent properties may be formed. Wet strength or water resistance is provided in the sheets by adding to the dilute aqueous suspension a small amount of synthetic resin having an affinity for the fibers.

Unfortunately, most of the natural and synthetic fibers presently enjoying great success in the woven fabric industry, such as cotton, cellulose esters, rayons, polyamides, polyesters, polyolefins, acrylics, and the like, do not exhibit this same inherent web-forming characteristic and cannot be beaten into a suspension. Consequently, a number of other methods have been developed, some practical and some not, for binding staple fibers thereof into a web having multi-directional strength.

Conventional carding equipment used in the weaving industry can produce fiber webs of uniform thickness suitable for impregnation with an adhesive or binder, but one drawback is that while lengthwise strength is usually good, cross-direction strength is generally not good at all, owing to the staple fibers being essentially parallel-laid, i.e., lengthwise of the fabric or in the machine direction of the material.

Random distribution of the fibers has been achieved by several methods, one of the most popular of which is that involving air-laying of the fibers by stripping same from a carded web by means of an air stream which then directs the fibers through a restricting throat which is controlled to adjust the thickness of the resulting web. The machine used for this purpose is called a "Rando-Webber" and was developed by a party named Buresh for the Curlator Corporation.

A number of methods have been developed for treating randomly-dispersed webs with a binder. Typically, a water-based emulsion binder system is used in which a thermoplastic or thermoset synthetic polymer latex is prepared and a loose web of fibers to be treated is immersed therein, using special equipment in view of the structural weakness of the web; the thus treated web is dried and cured to effect proper bonding. Alternatively, an aqueous or solvent solution binder system of a thermoplastic or thermoset resin may be used to impregnate the fibrous web.

Still other methods include the application of thermoplastic or thermoset resin powders to the fibers, before or after making a web of same, and passing the web through hot rolls or a hot press to bind the fibers together. Alternatively, thermoplastic fibers having a softening point below that of the base fibers may be interspersed in a web of the latter and sufficient heat and pressure applied, such as by the use of heated rolls, to soften the thermoplastic fibers and bind the fiber network together.

Commonly used latices for non-woven fabrics are those prepared from polymers of butadiene-styrene, butadiene-acrylonitrile, vinyl acetate, acrylic monomers, such as methyl acrylate, ethyl acrylate, methyl methacrylate, and the like. While the emulsion binder system using latexes is the most popular method of forming non-woven fabrics, the homopolymers, copolymers and terpolymers heretofore used therein have suffered from several or more shortcomings. Since, for example, the end uses to which the non-woven fabrics are put play a major role in determining what polymeric binder is used, it can readily be appreciated that the properties of the polymeric binder are critical.

Always a real consideration, also, in the selection of binders is the cost thereof. As is well known, non-woven products are presently used as, to name a few, interlinings, wiping cloths, mops, shoe innersoles, book bindings, backings for plastic sheets, liquid filters, sanitary products, ribbons, diapers, battings, insulation, etc. Obviously, the cost of the binder must be consistent with the end use intended for the non-woven fabric. Needless to say, however, as the end uses become more varied and more sophisticated, it can be expected that the price range will react accordingly.

While the acrylic polymer latices hereinbefore mentioned are presently enjoying significant success, it is no secret that the cost thereof is a drawback. An advantage these latices have is that non-woven fabrics prepared therefrom are generally soft, i.e., they have good "hand".

It is an object of the present invention to prepare effective, less expensive binder latex compositions which produce softer non-woven fabrics. More particularly, it is an object of the present invention to prepare enhanced ethylene-vinyl acetate binder latex compositions which exhibit greater film flexibility and provide non-woven fabrics having better "hand".

U.S. Pat. No. 2,674,619 is of interest.

INVENTION

The present invention relates to enhanced ethylene-vinyl acetate latex compositions useful as binders for non-woven fabrics. More particularly, the instant discovery concerns ethylene-vinyl acetate latexes treated with from about 5 to about 20 percent by weight, based upon the total weight of the polymer solids in the latex composition, of an alkyl polyether selected from a water-soluble dioxolane oligomer and a water-soluble or water-dispersible polyoxypropylene-polyoxyethylene block polymer. The block polymer generally has a molecular weight of polyoxypropylene hydrophobic base (forming a block) of from about 950 to about 4,000, preferably from about 2,000 to about 4,000, and polyoxyethylene hydrophilic groups at each end of the block, the combined weight of the hydrophilic groups amounting to about 10% to about 80%, by weight, of the total weight of the block polymer, preferably from about 10% to about 37%. U.S. Pat. No. 2,674,619 to Wyandotte Chemicals Corporation describes methods for preparing these block polymers. Typical such materials are called Pluronic polyols, which are marketed by Wyandotte Chemicals Corporation, Wyandotte, Michigan.

The polydioxolane is a water-soluble oligomer which may be prepared by polymerizing a dioxolane monomer in the presence of boron trifluoride etherate, i.e., $BF_3$- etherate, such as $BF_3$-dibutyl ether. Typical monomers suitable for preparing the oligomers are 1,3-dioxolane and 5-methyl-1,3-dioxolane.

The ethylene-vinyl acetate copolymer contemplated generally has from about 70 to about 90, preferably from about 70 to about 88, percent by weight vinyl acetate and from about 10 to about 30, preferably from about 12 to about 30, percent by weight ethylene, all of these percentages being based upon the total weight of the polymer.

While aqueous emulsions of these copolymers presently enjoy a price advantage over the popular acrylic polymer latices hereinbefore alluded to, heretofore the ethylene-vinyl acetate copolymers left something to be desired insofar as film flexibility is concerned and softness of the non-woven fabric treated therewith. According to the instant discovery, aqueous emulsions or latices of ethylene-vinyl acetate copolymers, generally containing from about 35 to about 67 percent by weight, preferably from about 48 to about 58 percent, of colloidally-suspended ethylene-vinyl acetate particles, are blended with a controlled amount of an alkyl polyether of the type contemplated herein, the amount of polyether being, as indicated hereinbefore, in the range of about 5% and about 20% by weight, based upon the total weight of the polymer solids in the latex composition. The resulting blend is then applied to various webs in a conventional manner.

The ethylene-vinyl acetate latex compositions contemplated herein for treatment with the additives of the present invention are generally prepared by reacting ethylene and vinyl acetate at elevated temperatures in the presence of water, surfactants, a polymerization catalyst and, usually, a buffer, protective colloid and defoamer.

Typical polymerization catalysts are the inorganic peroxides, such as hydrogen peroxide, alkali metal (e.g. sodium, potassium, lithium) and ammonium persulfates, perphosphates, perborates, azonitriles, such as alpha, alpha-azo-bis isobutyronitrile, and the like.

The catalyst concentration must be at least sufficient to initiate the polymerization reaction. Generally, from about 0.5 to about 2.5 percent by weight of catalyst is used, preferably from about 0.7 to about 1.5, based upon the total weight of the ethylene and vinyl acetate monomers.

Surfactants are employed to control latex viscosities. Among the desirable surfactants are the non-ionic surfactants, such as the Igepal (trademark of GAF Corporation) surfactants which are members of a homologous series of alkylphenoxypoly(ethyleneoxy)-ethanols, which series can be represented by general formula

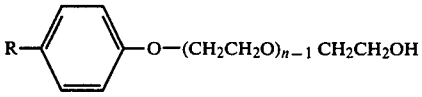

wherein R represents an alkyl substituent and n represents the number of moles of ethylene oxide employed. These non-ionic surfactants include alkylphenoxypoly(ethyleneoxy)-ethanols having alkyl groups containing between about 4 to about 18 carbon atoms and up to about 240 ethyleneoxy units, such as the heptylphenoxypoly(ethyleneoxy)-ethanols, nonylphenoxypoly(ethyleneoxy)-ethanols and dodecylphenoxypoly (ethyleneoxy)-ethanols. Other suitable non-ionic surfactants are the Tween products. Tween is a trademark of Atlas Powder Company denoting polyoxyalkylene derivatives of hexitol (including sorbitans, sorbides, mannitans and mannides) anhydride, partial long chain fatty acid esters, such as the polyoxyalkylene derivatives of sorbitan monolaurate, sorbitan monopalmitate, sorbitan monostearate, sorbitan tristearate, sorbitan monooleate, and sorbitan trioleate.

The preferred concentration of surfactant used in the polymerization step, expressed in parts per 100 parts total polymerizable monomer, is in the range of about 3.0 to about 12.0, preferably 3.5 to about 7.0.

Generally reaction is made to take place at a temperature in the range of about 60° C. to about 85° C., preferably about 65° C. to about 80° C. While atmospheric or sub-atmospheric pressures may be used, reaction is preferably carried out at somewhat elevated pressures, preferably below about 85–95 atmospheres.

The pH of the reactant medium, when too low, is best controlled during polymerization by the use of a small amount of a buffer. Generally pH is maintained in the acid range, about 2 to 6, and the preferred buffers are the alkali (K, Li, Na) acetates, carbonates, bicarbonates, e.g., sodium bicarbonate, potassium carbonate, sodium acetate, and like alkali organic salts.

As suggested hereinbefore, the latices of the present invention are generally prepared using a small but effective amount of a protective colloid. Typically, polyvinyl alcohol, carboxymethyl cellulose, Cellosize WP-09 hydroxyethyl cellulose (sold by Hercules Powder Company, Inc.), etc., are very effective protective colloids. The best suited colloid concentrations, based upon the total weight of the ethylene, vinyl acetate, and colloid, are in the range of about 0.005 to about 0.30 percent by weight.

Sufficient water is present along with the reactant monomers, catalyst, surfactant/s, protective colloid and buffer to provide an emulsion of desirable consistency and properties. Obviously, the ratio of reactant monomers to water may vary considerably, depending upon the solids content desired in the ultimate product. Should high solids be wanted, for instance, a monomers to water ratio substantially higher than 1:1 is used. For example, a 60% or higher solids latex is readily achieved by the use of 1.5:1, or higher, monomers to water ratios.

If desired, a minor amount of defoamer, such as Nopco NDW sold by Nopo Chemical Company, Inc., is added to the reactant medium, Nopco being the trademark for a blend of mixed hydrocarbons, metallic soaps and 0.5% silicone oil. Of course, other similar or suitable defoamers may likewise be used in lieu thereof or in conjunction therewith.

The ethylene-vinyl acetate copolymer emulsions contemplated herein are well known and are designated by various trademarks. Typical are the ethylene-vinyl acetate emulsions called Aircoflex 400, Aircoflex 500, Aircoflex 510, and Amsco Resin, the Aircoflex products being marketed by Airco Chemicals and Plastics and the Amsco products being sold by the American Mineral Spirits Co., a division of Union Oil Co. of California. These emulsions usually have a polymer (ethylene and vinyl acetate) content in the range hereinbefore stated, the emulsion having a total solids (polymer) content in the range of about 47 to about 65 percent by weight, based upon the total weight of the emulsion, the pH of the emulsion being between about 4 and 5 for storage stability. Likewise, the product of the present invention, while prepared as described hereinbefore under a broader range of pH conditions, is usually adjusted to between 4 and 6 for storage stability.

Catalysts suitable for curing the binders of the present invention are various organic and inorganic acids, such as oxalic acid, mineral acids (e.g. HCl), acid salts thereof, and the like. Preferably, based upon the total weight of polymer in the latices, the curing catalyst is present in the concentration of about 0.35 to about 2.5 percent by weight.

Bonding non-woven webs made by a number of processes, such as by the use of the "Rando-Webber" method hereinbefore described, may likewise be carried out in different conventional ways, such as impregnation or printing. For example, a rayon or polyester web weighing about 3 to about 5 ounces per square yard may be immersed in the aqueous latex composition of the present invention containing a curing catalyst, and from about 15 to about 90 percent, or more, resin on a dry weight basis deposited on the web, preferably from about 25 to about 60 percent resin. Drying and curing of the impregnated web may be accomplished by passing the thus treated web through an air oven (e.g., at a temperature of about 50° C. to about 90° C. for under ten minutes), and then through a curing oven at substantially higher temperatures (e.g., at a temperature of about 145° C. to about 155° C. for under about 7 minutes. Of course, drying and curing temperatures and times are selected on the basis of the web thickness, type of base fiber in the web (e.g., polyamide, cotton, poly-(ethylene terphthalate), acrylic, polyolefin, etc.), and other like considerations.

EXAMPLES

The present invention will better be understood from the following examples which are intended to be illustrative and not unduly limitative, all percentages given in the examples being by weight unless otherwise indicated. In the following table are typical commercial ethylene-vinyl acetate latex compositions which may be treated very effectively as taught herein to enhance film flexibility and thus the softness of non-woven fabric treated therewith:

Table I

| Polymer Properties | A(1) | B(2) | C(3) |
|---|---|---|---|
| Solids, % | 55.1 | 55.0 | 55.1 |
| Viscosity, cp, | 1,820 | 450 | 430 |
| pH | 4.5 | 4.6 | 4.1 |
| Inherent Viscosity(4) | 2.57 | — | 1.81 |
| Ethylene Content, wt. %(5) | 14.0–18.9 | 11.5–13.5 | 15.0 |
| Vinyl Acetate Content, wt. %(5) | 86.0–81.1 | 88.5–86.5 | 85 |

(1)Aircoflex 400 - marketed by Airco Chemicals and Plastics
(2)Aircoflex 500 - marketed by Airco Chemicals and Plastics
(3)Aircoflex 510 - marketed by Airco Chemicals and Plastics
(4)I.V. in 80% Acetic Acid, c = 0.1% @ 25° C.
(5)Weight % of polymer

EXAMPLE I

Dioxolane oligomer is prepared from 1,3-dioxolane by charging 600 grams of the latter to a 1,000-milliliter, round bottom reactor flask equipped with a reflux condenser. Also fed to the reactor are 14.6 grams of distilled water and 1.9 grams of $BF_3$-dibutyl ether.

The round bottom reactor flask is immersed in an oil bath set at 60° C.–65° C. for 24 hours. Then more $BF_3$. dibutyl ether (3.1 grams) is added and the mixture heated an additional 8 hours, whereupon it is cooled to room temperature. Next is added 10.2 grams of $KF.2H_2O$ in 175 milliliters of water and the mixture stirred, thus neutralizing the $BF_3$-etherate. Volatiles are then stripped from the resulting product at a maximum temperature of 35° C., @ 20 millimeters Hg.

A five (5) gram portion of the dioxolane oligomer thus produced is thoroughly mixed with 81.8 grams of Aircoflex 510 emulsion, i.e., 45 grams of ethylene-vinyl acetate polymer, and a thin film thereof formed on melamine-formaldehyde paper. When compared to a similar ethylene-vinyl acetate polymer film prepared from Aircoflex 510 only, i.e., containing no polydioxolane, the film product of the present invention exhibited enhanced flexibility.

EXAMPLE II

Fifty (50) grams of the polydioxolane-containing latex prepared as in Example I, above, is diluted with 250 grams of water and the mixture used to treat a number of non-woven 100% rayon webs made by the "Rando-Webber" process hereinabove discussed, the web thicknesses being such that the webs average from about 3 to about 5 ounces per square yard.

Small squares of these are dipped in the aqueous mixture, squeezed to remove excess liquid, and the resulting treated rayon web squares dried in a vacuum oven at a temperature of about 70° C.

Non-woven fabric squares thus treated with ethylene-vinyl acetate polymer containing polydioxolane oligomer, as just taught, contain from 1.0% to 153% of the additive. Comparison of these fabric squares with other similar fabric squares treated in the same way, but for the exclusion of dioxolane oligomer, reveals that the fabric squares containing dioxolane oligomer/ethylene-vinyl acetate polymer additive have a better "hand", i.e., they are softer to the touch.

EXAMPLE III

A five (5) gram portion of Pluronic L-121, a water-dispersible polyoxypropylene 80%/polyoxyethylene 10% block polymer having a molecular weight of about 4,000, is substituted in Example I, above, for the dioxolane oligomer mixed with 81.8 grams of Aircoflex 510 emulsion (i.e., 45 grams of ethylene-vinyl acetate polymer) and a thin film thereof formed on melamine-formaldehyde paper. Again, film flexibility when compared to a film prepared from Aircoflex 510 only, i.e., containing no Pluronic L-121, is superior.

EXAMPLE IV

Example II is repeated in every essential respect with the exception that, in lieu of the dioxolane oligomer, water-dispersible polyoxypropylene/polyoxyethylene block polymer is used, viz., Pluronic L-121 comprising 80% polyoxypropylene, 10% polyoxyethylene, and having a molecular weight of about 4,000 for the hydrophobic base (polyoxypropylene). Again, the non-woven fabric squares containing the block polymer/ethylene-vinyl acetate polymer additive have a better "hand".

While non-woven rayon fabric has been illustrated, the present invention contemplates both synthetic and natural fiber fabrics, including those made from polyamide, poly(ethylene terphthalate), polyolefin, polyacrylic, cotton, cellulose acetate, and other like fibers.

Of course, each of the latex compositions used to treat the fabrics in Examples II and IV may also contain a curing catalyst, of the type and in the concentrations hereinbefore described, to prepare cured non-woven fabrics at elevated temperatures, as also hereinabove defined. The resulting non-woven fabrics (cured) likewise have a better "hand" than those containing the same commercial binder composition but for the additives (oligomer and/or surfactant) of the present invention.

Pursuant to statutory requirements, there are described above the invention and what are now considered its best embodiments. It should be understood, however, that the invention can be practiced otherwise than specifically described, within the scope of the appended claims.

What is claimed is:

1. A non-woven fabric having improved flexibility and hand softness, which is formed from a web of fibers bound together by a polymer composition; said polymer composition having been prepared from an ethylene-vinyl acetate latex binder, wherein the ethylene-vinyl acetate copolymer contains about 70 to about 90 weight percent vinyl acetate, and said latex binder contains from about 35 to about 65 weight percent of colloidally-suspended ethylene-vinyl acetate, and wherein said polymer composition contains from about 5 to about 20 weight percent, based on the total polymer composition weight, of a water soluble or water dispersible polyoxypropylene/polyoxyethylene block polymer which comprises (1) a polyoxypropylene hydrophobic base of from about 2000 to about 4000 in molecular weight, and (2) polyoxyethylene hydrophilic groups at each end of the block which amount to about 10 percent to 37 weight percent of the block polymer weight.

2. A non-woven fabric having improved flexibility and hand softness, which is formed from a web of fibers bound together by a polymer composition; said polymer composition having been prepared from an ethylene-vinyl acetate latex binder, wherein the ethylene-vinyl acetate copolymer contains about 70 to about 90 weight percent vinyl acetate, and said latex binder contains from about 35 to about 65 weight percent of colloidally-suspended ethylene-vinyl acetate, and wherein said polymer composition contains from about 5 to about 20 weight percent of a water-soluble 1,3-dioxolane oligomer.

* * * * *